US005996923A

United States Patent [19]

Junquera

[11] Patent Number: 5,996,923

[45] Date of Patent: Dec. 7, 1999

[54] DEVICE TO AUTOMATICALLY ROLL UP BANDS

[75] Inventor: Lope Toran Junquera, Madrid, Spain

[73] Assignee: Box-Control, S.L., Spain

[21] Appl. No.: 09/170,820

[22] Filed: Oct. 13, 1998

[30] Foreign Application Priority Data

Oct. 14, 1997 [ES] Spain ..... 9702126

[51] Int. Cl.[6] ..... B65H 75/48

[52] U.S. Cl. ..... 242/375.3; 242/375; 160/315

[58] Field of Search ..... 242/375.3, 375; 160/245, 313, 315, 316, 318

[56] References Cited

U.S. PATENT DOCUMENTS

| | | | |
|---|---|---|---|
| 1,266,716 | 5/1918 | Rolland | 160/245 X |
| 1,366,340 | 1/1921 | Anderson | 242/375 |
| 1,641,506 | 9/1927 | Smurr | 160/315 |
| 1,766,746 | 6/1930 | Heckman | 160/315 |
| 4,033,397 | 7/1977 | McKee | 160/245 X |
| 4,427,050 | 1/1984 | Toppen | 160/315 |
| 4,429,729 | 2/1984 | Winslow | 160/315 |
| 4,482,137 | 11/1984 | Gavagan et al. | 160/315 X |
| 4,523,620 | 6/1985 | Mortellite | 160/315 |
| 5,078,198 | 1/1992 | Tedeschi | 160/315 |
| 5,275,223 | 1/1994 | Magro et al. | 160/316 X |

FOREIGN PATENT DOCUMENTS

| | | | |
|---|---|---|---|
| 458684 | 8/1949 | Canada | 160/313 |
| 1068583 | 1/1984 | U.S.S.R. | 160/313 |
| 252491 | 6/1926 | United Kingdom | 160/315 |

*Primary Examiner*—Donald P. Walsh
*Assistant Examiner*—Minh-Chau Pham
*Attorney, Agent, or Firm*—Ostrolenk, Fager, Gerb & Soffen, LLP

[57] ABSTRACT

The present invention automatically rolls up bands, such as curtains, sunshades and mobile panes. The present invention consists of a tubular structure which incorporates in its interior a spindle with two sections threaded in opposite directions acting, thorough rotation, upon corresponding mobile structures on each side, displacing them and causing a compression or traction of a spring placed between them. The tubular structure has in its interior side longitudinal protuberances, which fit into corresponding slits of the mobile structures, thus rotating as they move.

5 Claims, 1 Drawing Sheet

DEVICE TO AUTOMATICALLY ROLL UP BANDS

TECHNICAL FIELD

The field of the present invention is a procedure and its corresponding device to automatically roll up bands, such as curtains, sunshades and mobile panels.

BACKGROUND

Devices for this same purpose exist in the market, in which when the band is unrolled, an internal spring is charged by torsion. When the band is released, the spring recovers and rotates a tube, on which the band rolls up.

Although perfectly valid, the construction of these devices is quite complex and the life of the spring relatively shortlived, working as it does through uncontrolled torsion.

The device of the present invention, preserving the outside appearance of existing devices, works by compression or, alternatively, traction of the spring.

This device is made up of a totally or partially threaded axis, the thread being divided longitudinally into equal and symmetric parts, although threaded in opposite directions.

On this axis two mobile circular pieces, resembling washers, are screwed, while a spring is inserted over the axis between those two circular pieces.

These mobile pieces have projections which fit into longitudinal grooves of an external tube, or inversely, they may have slits where longitudinal projections of the external tube fit.

The device is completed with lateral covers, with inserts of the diameter of the external tube cut out, on which the tube fits. In this way, the outside tube turns over these covers, which also serve as stoppers for the mobile pieces, when these reach their stop positions.

When the band is pulled to unroll it, the external tube causes the mobile pieces to rotate, traversing along the threads, compressing the spring, at the same time as they glide to the middle along the grooves/projections of the external tube.

When the band is released, the spring pushes the mobile pieces, which unscrew, forcing the external tube to rotate in the reverse direction, at the same time as they glide longitudinally along the grooves/projections until they reach the stoppers of the band or the spring is totally decompressed.

This device may also operate the other way around; i.e., instead of compressing the spring, it is pulled as the mobile pieces unscrew towards the ends of the axis. To operate this way, it is necessary that the spring is fastened to the mobile pieces, something which is not necessary when the device operates by compression.

The device can also be constructed with only one mobile piece, in which case the other end will push on the lateral cover, being fixed to the external tube and freely rotating around the axis (not screwed), needing therefore an additional cover piece as a stopper to avoid the displacement of the tube along the axis when rotating.

The device can be operated by manual or motorized means.

In order to complete the description and with the aim to help to better understand the characteristics of the invention, a set of drawings, based on the preferential practical realization of it, are included as integral part of this description. With illustrative and not limitative purpose, the following is shown:

DETAILED DESCRIPTION OF THE INVENTION

Figure 1:
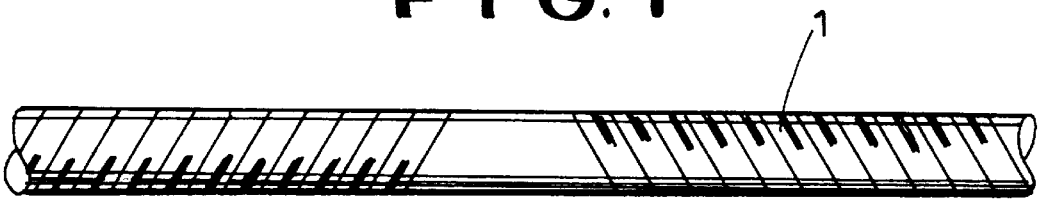
FIG. 1 illustrates the threaded axis portion of the present invention with an unthreaded central part. The two threaded parts are threaded in opposite directions.
Figure 2:
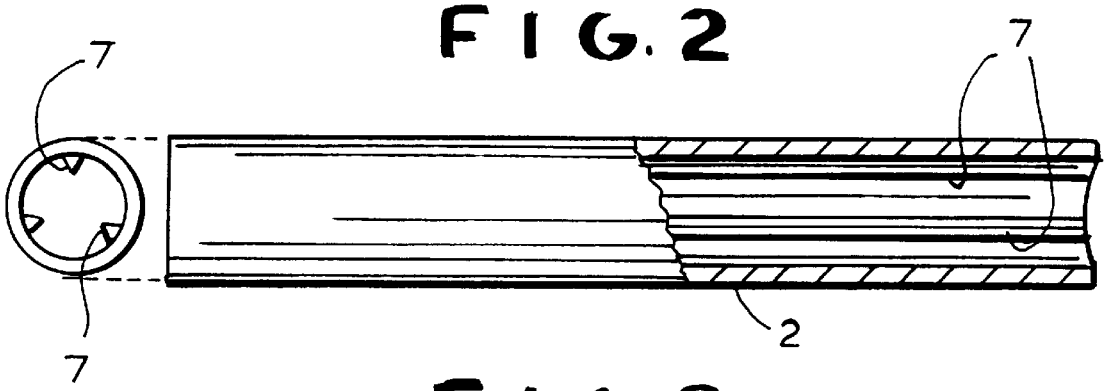
FIG. 2 depicts the external tube on which the band is rolled up. In the embodiment shown in this Figure, the profile of the external tube has interior projections at 120° to serve as guide for the mobile pieces.
Figure 3:
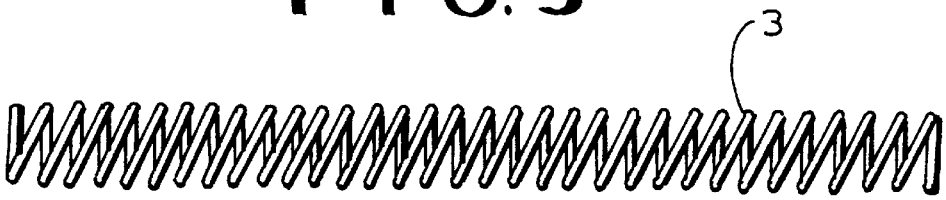
FIG. 3 illustrates the spring which is inserted over the axis of FIG. 1 between the mobile parts. In the illustrated embodiment, the spring is loose, because the device operated by compression.
Figure 4:
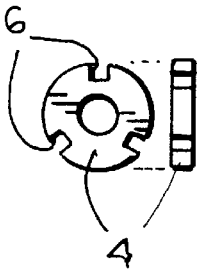
FIG. 4 shows a mobile piece. In the illustrated embodiment, two mobile pieces are used, threaded in opposite directions, one in each section of the axis. On their external rim the mobile pieces have three slits at 120°, into which the projections of the external tube, along which these mobile pieces glide longitudinally, fit.
Figure 5:
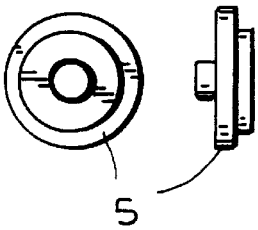
FIG. 5 illustrates the lateral cover, which fits on the external tube of FIG. 2 and is screwed to the axis of FIG. 1. Once in position, the lateral cover is immobilized. It supports the external tube when it rotates.
Figure 6:
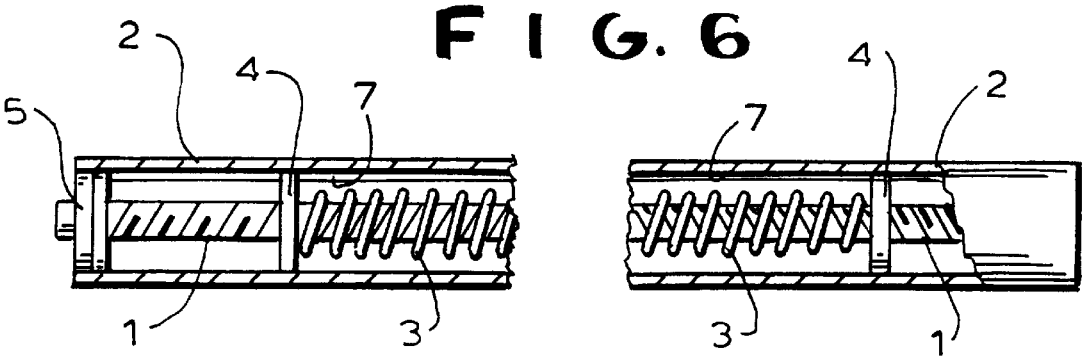
FIG. 6 illustrates an assembled compression device with two mobile parts (the right end is not shown).

With reference to FIGS. 1–6, the device of the present invention to automatically roll up bands, includes a threaded axis 1 having longitudinal symmetry. Each half of the axis 1 is threaded in an opposite direction with respect to the other halt. The axis 1 is inserted in a spring 3. Two mobile pieces 4 are then screwed on the axis 1, one on each side of the spring. The whole set is next introduced into an external tube 2, provided with longitudinal projections 7, that fit into slits 6 in the mobile pieces 4. The projections 7 allow the mobile pieces 4 to slide, only and exclusively in longitudinal direction along the external tube 2. A band is then fixed on on the external tube 2 by one of its ends and is rolled around the external tube. When the band is pulled to unroll it, the external tube is caused to rotate, which produces rotation of the mobile pieces 4 around the axis 1. As the mobile pieces 4 glide, under the effect of the threads, along the projections of the external tube 2 towards the middle, the spring 3 is compressed, with the result that when the band is released, it is automatically rerolled under the pressure of the spring 3, inverting the previous sequence.

Notwithstanding, the device can also be assembled with:

- one mobile piece 4 only, while the other end of the spring 3 pushes against the lateral cover 5, which is not screwed to the axis 1, but rotates instead by being fixed to the external tube 2. In this embodiment, another stopper cover is needed on the axis 1;
- a spring 3 for traction fixed to the mobile pieces 4;
- projections, including bearings, in the mobile pieces 4 and grooves in the external tube 2 or the other way around;
- a mobile piece 4 in which the inner thread has been reduced to the minimum, such as three contact points, which can also be bearings, or simple pins;
- an unthreaded axis 1 along which the mobile pieces 4 glide, only and exclusively, in longitudinal direction, while on the exterior rim of these a thread is placed, to make the external tube 2 rotate, as it is also threaded internally.

It is not considered necessary to make this description of the device any longer for any expert to appreciate the essentials of it and the advantages with respect to the traditional device.

The materials, shape, size and disposition of the elements will be susceptible to changes, as long as they don't imply an alternation of the essentials of the invention.

The terms in which this memorandum has been drafted shall always be taken in an ample and not restrictive sense.

I claim:

1. A device for automatically rolling up bands, comprising:

a threaded axis having longitudinal symmetry, two sections of the threaded axis being threaded in opposite directions;

a mobile piece threaded on each section of the threaded axis, wherein rotation of the threaded axis displaces the mobile pieces longitudinally along the threaded axis either toward or away from each other;

a helical spring inserted over the threaded axis and exerting pressure on the mobile pieces; and an external tubular body disposed around the threaded axis, the helical spring and the mobile piece.

2. The device as recited in claim 1, further comprising the external tubular body having an inner wall;

longitudinal ribs or grooves formed along the inner wall of the external tubular body.

3. The device as recited in claim 2, further comprising at least one of slits or projections formed in outer rims of the mobile pieces and cooperating respectively with the ribs or grooves of the external tubular body to allow the mobile pieces to glide therealong and be guided thereby.

4. The device as recited in claim 1, wherein the spring is fixed to the mobile pieces, allowing the device to operate in one direction by compression and in an opposite direction by traction.

5. A device for automatically rolling up bands, comprising:

a threaded axis having longitudinal symmetry, two sections of the threaded axis being threaded in opposite directions;

a mobile piece threaded on the threaded axis, wherein rotation of the threaded axis displaces the mobile piece longitudinally;

a helical spring inserted over the threaded axis and exerting pressure on the mobile piece;

an external tubular body disposed around the threaded axis, the helical spring and the mobile piece; and a cover piece rotatably coupled to an end of the external tubular body and fixedly coupled to one end of the helical spring.

* * * * *